US005356038A

United States Patent [19]

Banks

[11] Patent Number: 5,356,038

[45] Date of Patent: Oct. 18, 1994

[54] WALL MOUNTABLE CREAM TUBE DISPENSER

[75] Inventor: Stewart Banks, Brantford, Canada

[73] Assignee: Sprintvest Corporation N.V., Curacao, Netherlands Antilles

[21] Appl. No.: 2,348

[22] Filed: Jan. 21, 1993

[51] Int. Cl.[5] ..... B65D 35/54

[52] U.S. Cl. ..... 222/96; 222/153; 222/181; 222/341

[58] Field of Search ..... 222/95, 96, 105, 180, 222/181, 340, 341, 153

[56] References Cited

U.S. PATENT DOCUMENTS

| | | | |
|---|---|---|---|
| 2,709,025 | 5/1955 | Scott | 222/95 X |
| 3,211,340 | 10/1965 | Zander et al. | 222/340 X |
| 3,465,924 | 9/1969 | Michaels | 222/341 X |
| 3,580,429 | 5/1971 | Trindle | 222/341 X |
| 4,164,306 | 8/1979 | Perrin | 222/181 |
| 4,461,445 | 6/1984 | Williamson et al. | 222/181 X |
| 4,564,127 | 1/1986 | Garabedian et al. | 222/96 |

*Primary Examiner*—Andres Kashnikow
*Assistant Examiner*—Joseph A. Kaufman
*Attorney, Agent, or Firm*—Shlesinger Arkwright & Garvey

[57] ABSTRACT

A wall mountable cream tube dispenser for dispensing cream is disclosed. The dispenser includes a wall mount having a slot and a movable locking lever with a tongue, and includes a separate dispenser mechanism provided with a guide plate having a groove. The lever is elongated and has a proximal end attached to the wall mount and a distal end spaced therefrom. The tongue is positioned between the proximal end and the distal end of the lever. The wall mount is mounted on a wall or other supporting surface and the guide plate is inserted into the slot whereupon the tongue is received into the groove to form a tongue-in-groove connection. The tongue-in-groove connection is decoupled by pressing on the free end of the lever thereby deforming the lever and pulling the tongue from the groove. Various types of cream tubes may be attached to the dispenser mechanism, including toothpaste, hand and face creams, hair gel and the like. The dispenser mechanism includes a pushbutton pump for dispensing cream from the tube which is hand or finger actuated by a pushbutton.

8 Claims, 4 Drawing Sheets

WALL MOUNTABLE CREAM TUBE DISPENSER

FIELD OF THE INVENTION

The present invention relates to wall mountable cream tube dispensers.

BACKGROUND OF THE INVENTION

Cream tubes for personal hygiene and grooming such as toothpaste, hand and face creams, hair gel and the like are well known. Dispensing cream from the tubes is accomplished by removing the tube cap and squeezing the tube whereby the contents are forced out.

Dispenser mechanisms that improve and further ease the dispensing of the contents of cream tubes are also well known. One type of such dispenser mechanism is usually connected to the tube opening and includes a hand or finger actuated pump for dispensing the tube contents. A drawback of this arrangement is that although the action of dispensing cream from the tube is rendered easier, other problems associated with using tubes, independent of the dispensing action, still exist. For example, problems such as the tube being misplaced or lost, the tube taking up space on the counter, and the attached dispensing mechanism being damaged through constant handling or mishandling are common.

Accordingly, it is advantageous to provide a dispenser for toothpaste, hand and face creams, hair gel and the like which can be releasably attached to a wall mount which in turn is attachable to a wall or other

SUMMARY OF THE INVENTION

The present invention provides a wall mountable tube dispenser of the type having a housing provided with a receiving means for receiving the holding a tube. The housing includes a discharge outlet for discharging cream from the tube dispenser and a pump means for pumping material from the tube through the outlet. The improvement in the dispenser comprises a mounting bracket being mountable to a support surface. The housing includes attachment means for releasably attaching the tube dispenser to the mounting bracket. The attachment means including a guide plate and the mounting bracket includes a slot for receiving therein the guide plate. Included is an elongate lever having a distal end and an proximal end. The lever is attached to the mounting bracket at the proximal end. The elongate lever has a tongue member attached thereto between the proximal and distal ends which extends into the slot. The guide plate is provided with a groove for receiving therein the tongue member to form a tongue-in-groove connection. The elongate lever is resiliently movable with respect to the mounting bracket, wherein the tongue-in-groove connection is uncoupled by moving the distal end of elongate lever.

In another aspect of the invention there is provided a tube dispenser comprising a housing provided with receiving means for receiving and holding a tube. The housing includes a discharge outlet for discharging material from the dispenser. Included is a hand actuated pump means operably coupled to the housing for pumping material from the tube through the discharge outlet. The dispenser includes a mounting bracket being mountable to a support surface. The housing includes attachment means for releasably attaching the dispenser to the mounting bracket. The attachment means including a guide plate and the mounting bracket includes a slot for receiving therein the guide plate. Included is an elongate lever having a proximal end and a distal end wherein the lever is attached to the mounting bracket at the proximal end. The elongate lever has a tongue member attached at between the proximal end and the distal end which extends into the slot. The guide plate is provided with a groove for receiving therein the tongue member to form a tongue-in-groove connection. The elongate lever is resiliently movable with respect to the mounting bracket, wherein the tongue-in-groove connection is uncoupled by moving the distal end of elongate lever.

An advantage of the wall mountable cream tube dispenser disclosed herein is that once mounted at a fixed, dedicated location it is readily located and easily accessible. The wall mount location is determined by the preference of the user.

BRIEF DESCRIPTION OF THE DRAWINGS

The wall mountable cream dispenser forming the subject invention will now be described, reference being had to the accompanying drawings, in which.

DETAILED DESCRIPTION OF THE INVENTION

Figure 1:
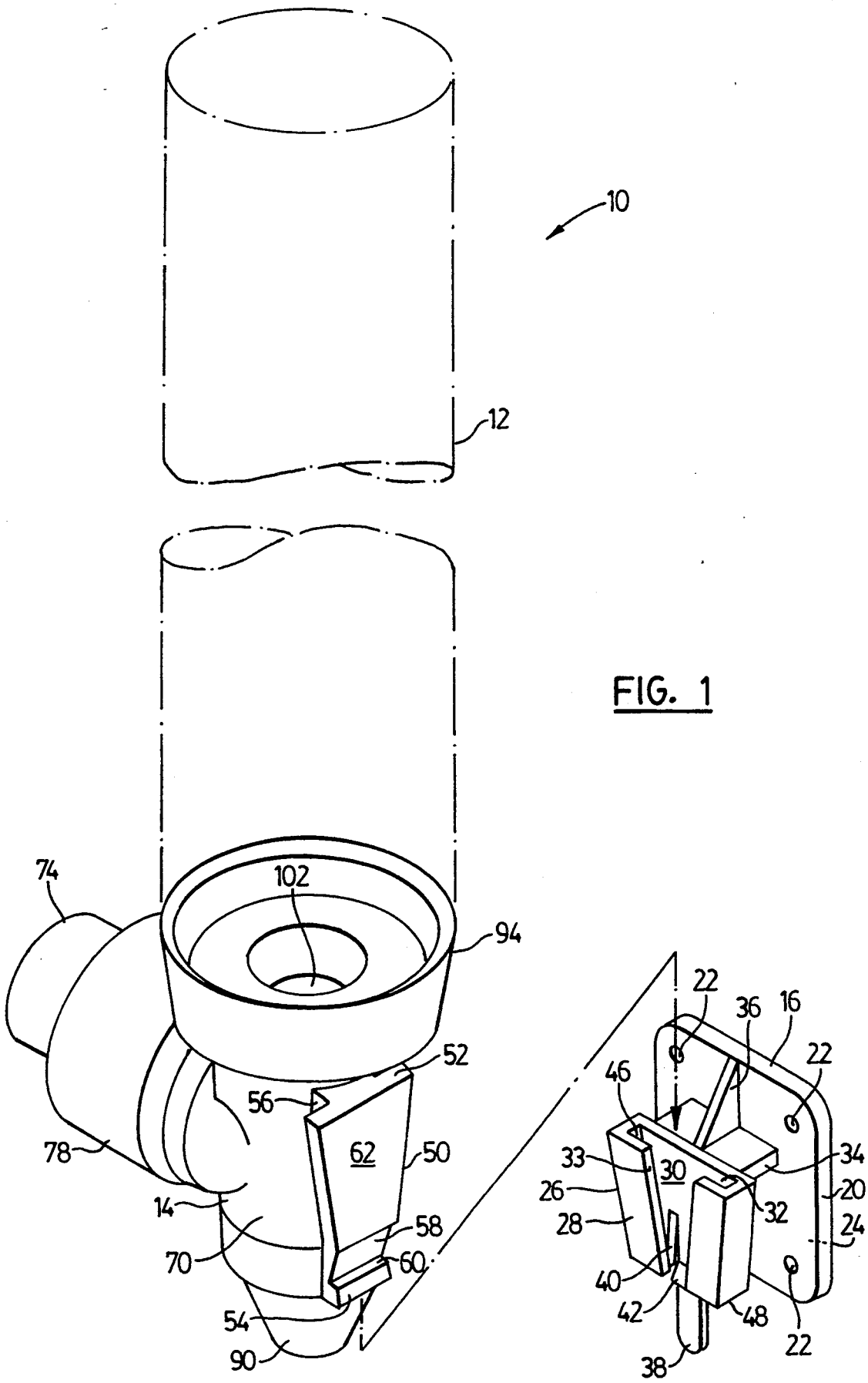
FIG. 1 is a perspective view, broken of a cream tube in a dispensing mechanism and an associated wall mount made in accordance with the present invention.
Figure 2:
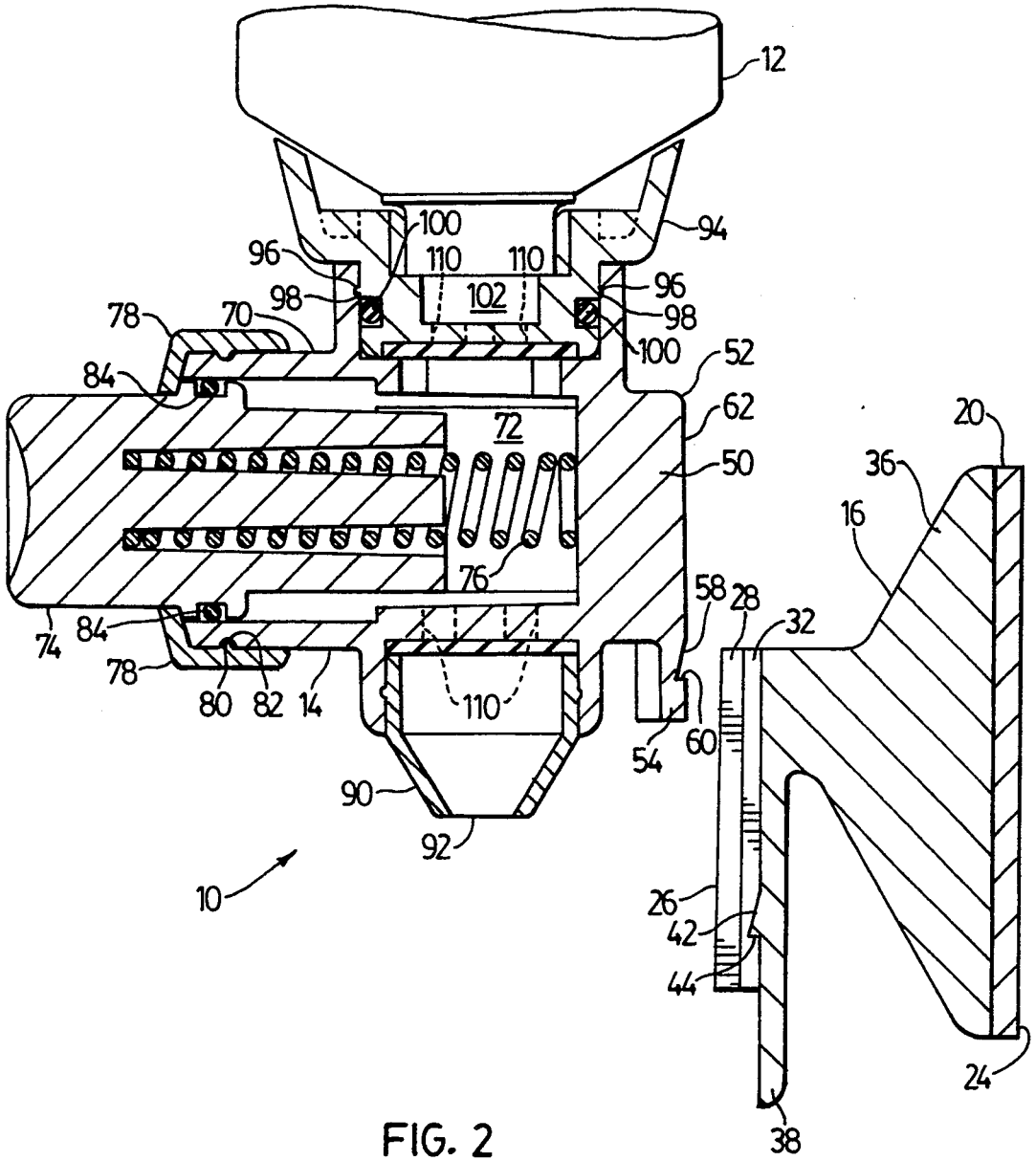
FIG. 2 is a sectional view, broken away, of the wall mount and cream dispenser of FIG. 1.
Figure 3A:
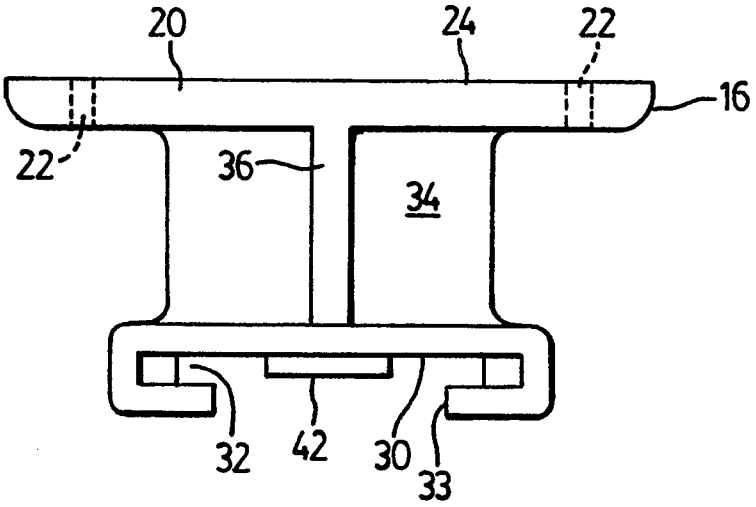
FIG. 3*a* is a top view of the wall mount of FIG. 1.
Figure 3B:
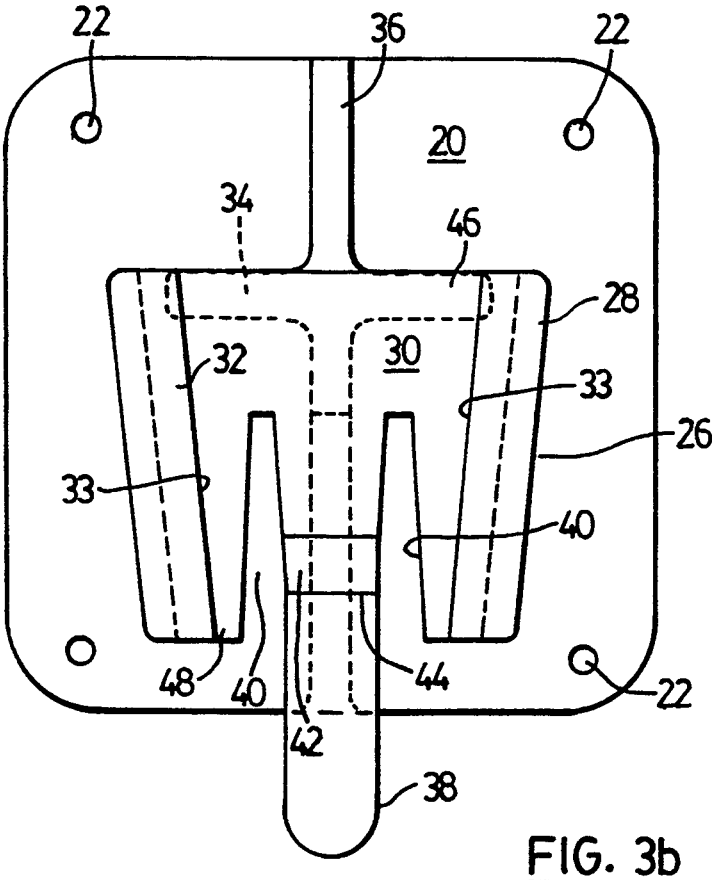
FIG. 3*b* is a front elevation of the wall mount of FIG. 1.

In the ensuing description of the structure and operation of the wall mountable cream dispenser forming the present invention, reference will be made to the drawings in which like numerals refer to like parts. Referring first to FIGS. 1 and 2, a dis-assembled wall mountable cream dispenser is shown generally at 10 and comprises three separable parts including a replaceable cream tube 12, a dispenser mechanism 14 and a wall mount bracket 16. Tube 12 and wall mount bracket 16 are fabricated of a readily deformable material such as for example plastic and dispenser mechanism 14 may be fabricated from a number of suitable materials including plastic and stainless steel, or a combination thereof.

Wall mount bracket 16 is a unitary single unit comprising a planar portion 20 wall having holes 22 extending therethrough and a flat face 24. Wall mount bracket 16 includes a locking mechanism 26 comprising a guide bracket 28 having a back wall 30, a slot 32 and a tapered cut-out portion 33 extending along the length of the guide bracket. Guide bracket 28 is connected to plate 20 by an attachment web 34 which is reinforced and strengthened by a triangular shaped web 36 attached to web 34 and plate 20. Locking mechanism 26 is provided with release lever 38 integrally formed with back wall 30 of guide bracket 28 and extending away therefrom parallel to slot 32. Cut-outs 40 on each side of lever 38 enable the lever to be flexibly moved in and out of the plane of back wall 30. Release lever 38 includes a triangular shaped tongue 42 integrally formed therewith and extending transversely thereacross adjacent the bottom edge of guide bracket 28. Tongue 42 includes a surface 44 extending perpendicular to the plane of back wall 30. Slot 32 is tapered from a wide end 46 to a narrow end 48, the latter being positioned adjacent tongue 42.

Guide bracket 28, tapered cut-out portion 33 and slot 32 are dimensioned to receive therein a guide plate 50 attached to dispenser mechanism 14 and which is tapered from a top wide end 52 to a bottom narrow end 54. A tapered web 56 connects guide plate 50 to the rest of dispenser mechanism 14 and tapered cut-out portion 33 is dimensioned to receive therein web 56. Guide plate 50 is provided with a groove 58 extending transversely thereacross adjacent narrow end 54. Groove 58 is bounded by a surface 60 which is perpendicular to surface 62 of plate 50. In operation, mounting bracket 16 is attached to a wall or other planar support surface by using screws (not shown) through holes 22. Alternatively, in other embodiments of mounting bracket 16 in which holes 22 are absent, double sided tape or glue applied to surface 24 may be used. Dispenser mechanism 14, with or without cream tube 12 mounted therein, is attached to mounting bracket 16 by inserting narrow end 54 of guide plate 50 into wide end 44 of slot 32 in guide bracket 28 and sliding the guide plate in the slot until release lever 38 resiliently deforms as portion 54 of plate 50 passes over tongue 42 and snaps back when tongue 42 is received into groove 58.

Figure 5:
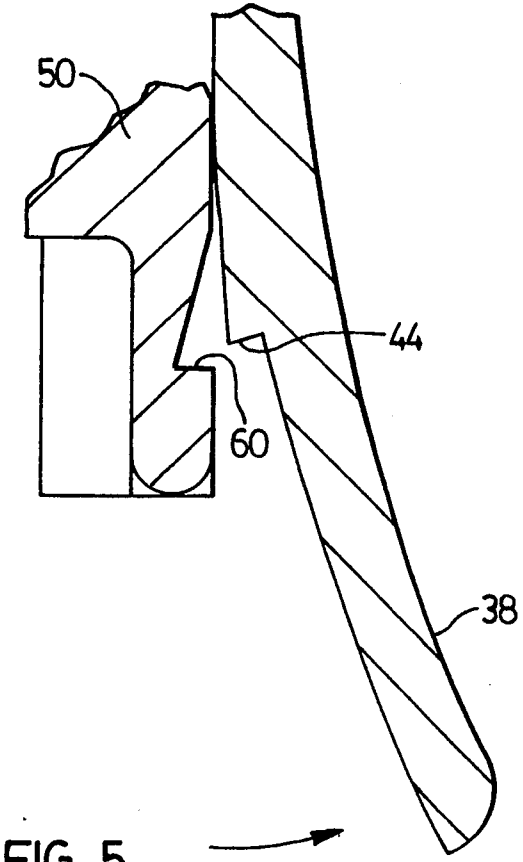
FIG. 5 is a sectional view similar to FIG. 4 of the lower part of the cream dispenser and the wall mount showing the first step in releasing the cream tube from the wall mount.
Figure 4:
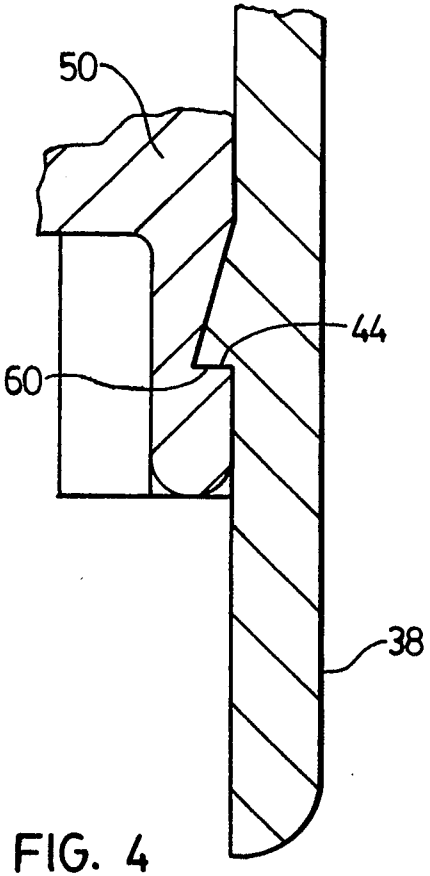
FIG. 4 is a detailed sectional view, broken away, of the lower part of the cream dispenser and the wall mount of FIG. 2 but assembled, showing the mating of the two thereof.

In this assembled position, surface 60 of guide plate 50 is in adjacent, abutting relation to surface 44 of tongue 42 so that dispenser mechanism 14 is lockingly engaged with wall mount bracket 16, best seen in FIG. 4. Referring to FIG. 5, in order to remove dispenser mechanism 14 from wall mount 16, locking lever 38 is moved towards plate 20 whereby tongue 42 is removed from groove 58 and the dispenser mechanism slidingly removed from wall mount 16.

Lever 38 is made of a material that is sufficiently resilient in order to allow it to bend and return to its original shape when attaching and detaching dispenser 14 from wall mount 16. Moreover, the length of lever 38 is also important as it determines the amount of pressure required to bend the lever and the amount of stress placed on the bend location. Lever 38 should extend downward from tongue 42 far enough such that an appropriate amount of force to detach tongue 42 from groove 58 is required and cut-outs 40 should extend upward from tongue 42 such that the stress placed on the bend location is minimal.

Dispenser mechanism 14 to which guide plate 50 is attached comprises a housing 70 enclosing a chamber 72 and a pushbutton 74 mounted in the housing on the opposite side thereof to which guide plate 50 is attached. Pushbutton 74 is biased rearward by a spring 76 mounted between the pushbutton and the interior portion of housing 70 adjacent plate 50. Pushbutton 74 is removably mounted within housing 70 by means of a cylindrical retainer 78 provided with an inner circumferential rib 80 which snaps into a groove 82 circumferentially disposed about the cylindrical portion of housing 70, best seen in FIG. 2. An O-ring 84 is circumferentially disposed about pushbutton 74 to act as a seal between chamber 72 and the exterior of housing 70 adjacent retainer 78.

Dispenser mechanism 14 includes an outlet nozzle 90 enclosing passageway 92 located at the bottom thereof and a cream tube receptacle 94 and positioned so that outlet passageway 90 and cream tube 12 are collinearly aligned. Cream tube receptacle 94 is provided with a circumferential rib 96 which snaps into a groove 98 circumferentially disposed about the adjacent portion of housing 70. Receptacle portion 94 is provided with an O-ring 100 circumferentially disposed thereabout to act as a seal between the receptacle and housing 70. A cream flow path through dispenser mechanism 14 comprises outlet passageway 92 in flow communication with cavity 72 which is in flow communication with a passageway 102 within receptacle portion 94. When cream tube is uncapped, it is threaded into receptacle portion 94.

When dispenser button 74 is pressed inwardly, the volume of cavity 72 is decreased thereby causing the cream contents located in cavity 72 to be dispensed through outlet passageway 92. Dispenser button 74 is returned to the rearward position by spring 76 once the operator releases the button. When dispenser button 74 returns to the rearward position, a reduced pressure is formed in cavity 72 thereby drawing cream from cream tube 12. This cream will remain in cavity 72 until dispenser button 74 is once again pressed. One way valves 110 prevent cream from back flowing into cream tube 12 when dispenser button 74 is pressed and prevents air being drawn through outlet passageway 92 into cavity 72 when dispenser button 74 returns to its rearward position. Advantageously, the dispenser mechanism being separable from the wall mount permits ready replacement of tube 12 in addition to easy cleaning of the dispenser.

Those skilled in the art will appreciate that numerous embodiments of dispenser mechanism 14 may be employed with the detachable wall mount forming the subject invention. In addition, the structural details of wall mount 16 may be varied considerably. Therefore, while the wall mountable cream dispenser has been described and illustrated with respect to the embodiments disclosed herein, it will be appreciated that numerous variations of these embodiments may be made without departing from the scope of the invention disclosed herein.

Therefore what is claimed is:

1. In a tube dispenser of the type having a housing provided with a receiving means for receiving and holding a tube, the housing including a discharge outlet for discharging material from said tube dispenser, and pump means for pumping material from said tube through said outlet, the improvement in the dispenser comprising;

a) a mounting bracket being mountable to a support surface; and b) said housing including attachment means for releasably attaching said tube dispenser to said mounting bracket, said attachment means including a guide plate, said mounting bracket including a slot for receiving therein said guide plate, including an elongate lever having a proximal end and a distal end, said lever being attached to said mounting bracket at said proximal end, said elongate lever having a tongue member attached thereto between said distal end and said proximal end and extending into said slot, said guide plate provided with a groove for receiving therein said tongue member to form a tongue-in-groove connection, the elongate lever being resiliently movable with respect to said mounting bracket, wherein the tongue-in-groove connection is uncoupled by moving the distal end of elongate lever.

2. A tube dispenser according to claim 1 wherein said guide plate is tapered from a wide end to a narrow end, and wherein said slot is tapered from a wide end to a narrow end to receive said tapered guide plate therein.

3. A cream tube dispenser according to claim 2 wherein said pump means comprises a pushbutton slidingly movable in said housing, the pushbutton being mounted on one side of said housing and said guide plate being mounted on the other side of the housing in opposed relation to said guide bracket.

4. A tube dispenser according to claim 1 wherein said mounting bracket includes a planar portion adapted to be secured to said support surface.

5. A tube dispenser, comprising:

a) a housing provided with receiving means for receiving and holding a tube, the housing including a discharge outlet for discharging material from said dispenser;

b) hand actuated pump means operably coupled to said housing for pumping material from said tube through said discharge outlet;

c) a mounting bracket being mountable to a support surface; and d) said housing including attachment means for releasably attaching said dispenser to said mounting bracket, said attachment means including a guide plate, said mounting bracket including a slot for receiving therein said guide plate, including an elongate lever having a proximal end and a distal end, said lever being attached to said mounting bracket at said proximal end, said elongate lever having a tongue member attached thereto between said distal end and said proximal end and extending into said slot, said guide plate provided with a groove for receiving therein said tongue member to form a tongue-in-groove connection, the elongate lever being resiliently movable with respect to said mounting bracket, wherein the tongue-in-groove connection is uncoupled by moving the distal end of elongate lever.

6. A tube dispenser according to claim 5 wherein said guide plate is tapered from a wide end to a narrow end, and wherein said slot is tapered from a wide end to a narrow end to receive said tapered guide plate therein.

7. A cream tube dispenser according to claim 6 wherein said pump means comprises a pushbutton slidingly movable in said housing, the pushbutton being mounted on one side of said housing and said guide plate being mounted on the other side of the housing in opposed relation to said guide bracket.

8. A tube dispenser according to claim 5 wherein said mounting bracket includes a planar portion adapted to be secured to said support surface.

* * * * *